United States Patent [19]
Hochstrasser
[11] 4,262,927
[45] Apr. 21, 1981

[54] STREAMLINED TIP FOR A SKI

[76] Inventor: Peter Hochstrasser, Alpenblickstr. 11, 8630 Rüti/ZH, Switzerland

[21] Appl. No.: 35,246

[22] Filed: May 2, 1979

[30] Foreign Application Priority Data

May 5, 1978 [CH] Switzerland ..... 48761/78

[51] Int. Cl.³ ..... A63C 5/00
[52] U.S. Cl. ..... 280/609; 280/28
[58] Field of Search ..... 280/601, 11.37 E, 11.37 R, 280/609, 608, 124, 28, 809

[56] References Cited

U.S. PATENT DOCUMENTS

| | | | |
|---|---|---|---|
| 1,595,632 | 8/1926 | Taft | 280/601 |
| 2,611,624 | 9/1923 | Gurvich | 280/601 |

FOREIGN PATENT DOCUMENTS

| | | | |
|---|---|---|---|
| 2705390 | 8/1977 | Fed. Rep. of Germany | 280/609 |
| 1376289 | 9/1964 | France | 280/608 |
| 212221 | 2/1941 | Switzerland | 280/608 |
| 272297 | 3/1951 | Switzerland | 280/609 |
| 362634 | 7/1962 | Switzerland | 280/609 |
| 573256 | 3/1976 | Switzerland | 280/601 |

*Primary Examiner*—John J. Love
*Assistant Examiner*—Milton L. Smith
*Attorney, Agent, or Firm*—Ostrolenk, Faber, Gerb & Soffen

[57] ABSTRACT

The tip of a ski, particularly a racing ski, is streamlined. A shaped body is arranged on the upper surface of the ski tip. The bottom running surface of the ski terminates in a tip portion, which is bent forward and upward out of the running surface so as to provide guide stability to the ski. The upwardly bent portion has a generally triangular shaped surface. The triangular surface passes into a rounded, centrally longitudinally extending, air-dividing ridge. The ridge merges at both its lateral sides into concave side surfaces which appear like upwardly inclined sides, and these merge via a rounding, into the convexly rounded upper surface of the shaped body. The ridge has a point of inflection in its course with respect to the central longitudinal plane of the ski. The ski tip is developed in longitudinal section to have a curved form which appears like a thrush head or dolphin head.

16 Claims, 13 Drawing Figures

STREAMLINED TIP FOR A SKI

BACKGROUND OF THE INVENTION

The present invention relates to a ski, particularly a racing ski, having a streamlined body at the upper surface of the ski tip.

It is conventional to reduce the aerodynamic drag of a ski by placing a shaped body on the upper surface of the tip (Swiss Pat. No. 573,256). In this way, the form drag coefficient of the ski can be reduced by about 50%. The aerodynamic body provided on the upper surface of the ski tip may be hollow and be comprised of plastic material. FIG. 4 of the aforesaid Swiss patent shows that the shaped body produces a relative reduction in drag of about 40% at speeds of about 100 km/hour. However, this drag reduction is insufficient in modern ski racing, particularly in downhill racing, where the differences in the racing times of the leaders may be as small as hundredths of a second.

SUMMARY OF THE INVENTION

The object of the present invention is to create a fairing which reduces aerodynamic drag of a ski by at least 60% of the drag without the fairing, particularly where the ski has guide properties which are at least approximately equal to those of skis without such a fairing.

According to the invention, the tip of a ski, particularly a racing ski, is streamlined. A shaped body is arranged on the upper surface of the ski tip. The bottom running surface of the ski terminates in a tip, which is bent forward and upward out of the running surface so as to provide guide stability to the ski. The upwardly bent section has a generally triangular shaped surface. The triangular surface passes into a rounded, centrally longitudinally extending, air-dividing ridge. The central ridge merges at both its lateral sides into concavely surfaced upwardly inclined sides, and these merge via respective roundings, into the upper surface of the shaped body. The ridge has a point of inflection in its course with respect to the central longitudinal plane of the ski. The ski tip is developed, in longitudinal section through the central plane of the ski tip, to have a generally S-curved form which appears like a thrush head or dolphin head.

BRIEF DESCRIPTION OF THE DRAWINGS

Other objects and features of the invention are explained below with reference to the drawings in which.

DESCRIPTION OF THE PREFERRED EMBODIMENTS

Figure 13:
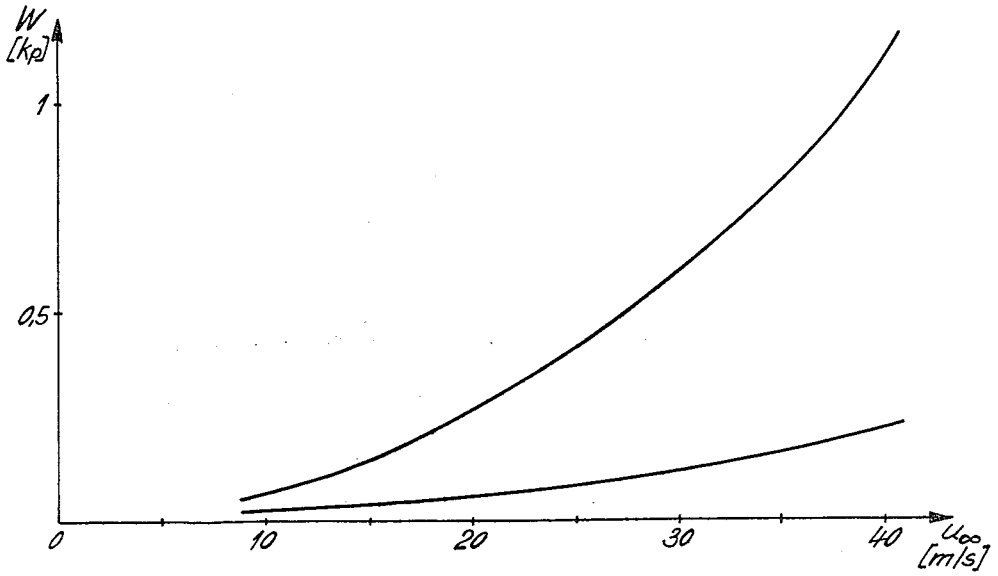
FIG. 13 is a speed/form-drag diagram comparing a curve for a normal ski and a curve for a ski with aerodynamic fairing, similar to FIGS. 1 to 4, measured in the wind tunnel of the Aerodynamic Institute of the Polytechnical Institute of Zurich.

The fairing of a ski tip, such as that shown in FIGS. 1–4, and which produced the form drag curve plotted in FIG. 13, includes an upper ski surface 1 having a shaped body 2 which covers, for instance, the normal ski tip at the front of the ski.

The head part 4 of the body 2 has a curved shape approximating the shape of the head of a common thrush or an ordinary dolphin. The shaped body 2 has an upper body surface 5 which has a rounded top apex and a generally triangular transverse cross-section, including downwardly sloping sides that merge into the below described side surfaces 7 and 8. The surface 5 has a gradually curved S-shaped longitudinal cross-section, terminating in a sharply dipping front tip end. The upper body surface 5 merges into the upper ski surface 1 toward the rear of surface 5.

Figure 1:
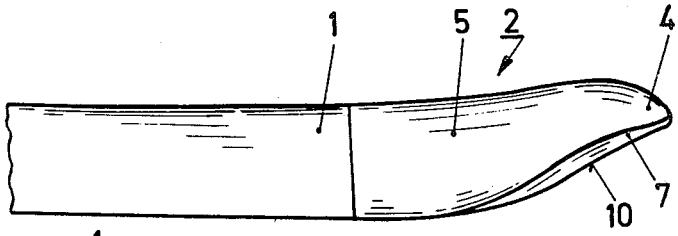
FIG. 1 is a perspective view showing a front part of a ski including a tip according to the invention, viewed from the upper right side.
Figure 2:
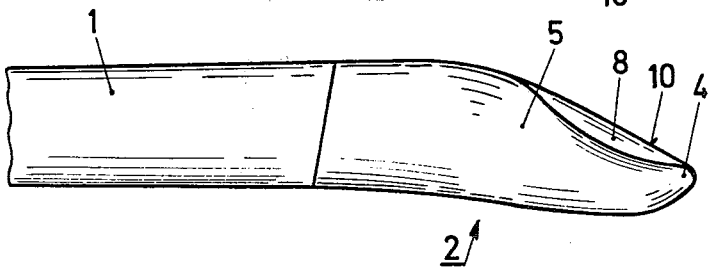
FIG. 2 is a perspective view of the same ski, viewed from the upper left.

The body 2 includes bottom side surfaces 7 and 8 shown in FIGS. 1 and 2, which meet at a central, longitudinally extending bottom ridge 10. The ridge 10 can be rounded to a greater or lesser extent, with minimum rounding being necessary for reasons of safety. In contrast to the convexly curved upper body surface 5, the side surfaces 7, 8 are developed concavely, at least in part. The ski tip narrows to the front of the ski and the side surfaces 7, 8 both incline in their orientations toward each other, toward the front of the ski. The side surfaces also are inclined upwardly moving outwardly from the ridge 10. The two side surfaces 7 and 8 also merge, in more or less pronounced respective roundings, into the upper surface 5 of the shaped body.

Figure 3:
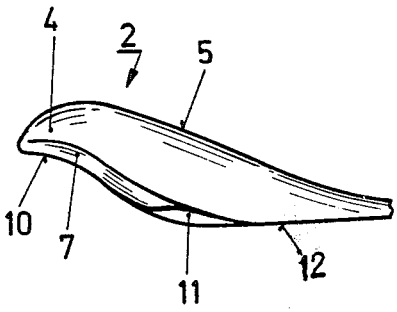
FIG. 3 is a perspective view of the faired ski tip, viewed from the bottom left.
Figure 4:
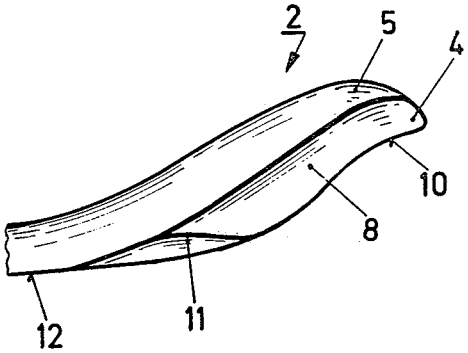
FIG. 4 is a perspective view of the faired tip, seen from the bottom right.
Figure 6:
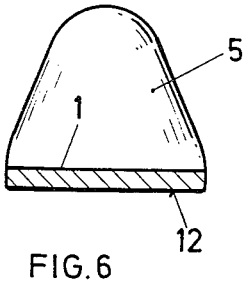
FIG. 6 is a transverse cross-sectional view of the ski tip of FIG. 5 looking forward from the binding side.
Figure 5:
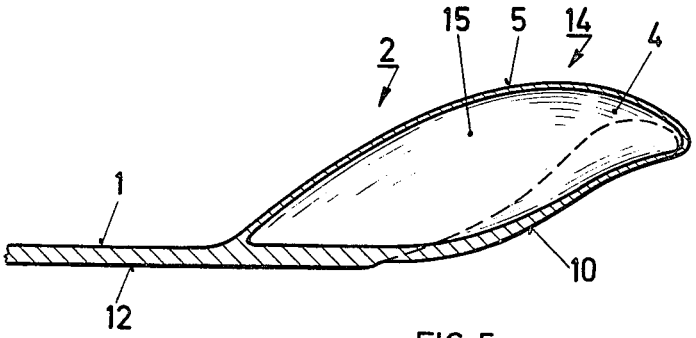
FIG. 5 is a central longitudinal section through a ski tip similar to that shown in FIGS. 1 to 4, shown diagrammatically.
Figure 7:
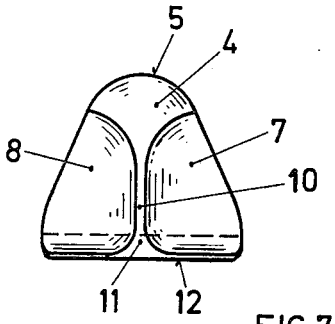
FIG. 7 is a view of the ski tip of FIG. 5, viewed from the front.
Figure 8:
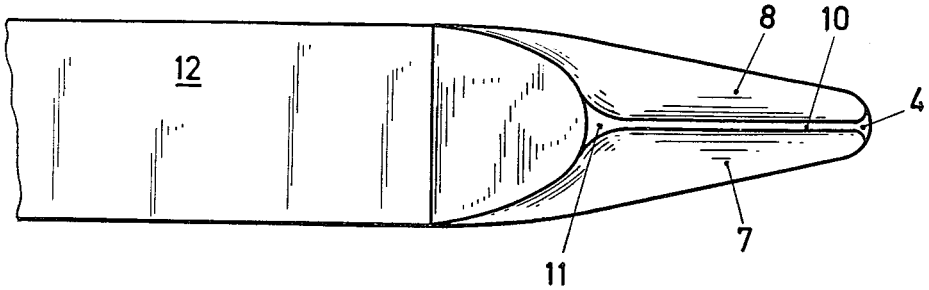
FIG. 8 is a view of the ski tip of FIG. 5, viewed from the bottom.

As can be seen in FIGS. 3 and 4, the under or running surface 12 of the ski is flat toward the ground, but the shaping of inclined, side surfaces 7, 8 causes the surface 12 to terminate, in the region of the ski tip, in the shape of a lower triangle 11, with its apex at the ridge 10. This triangular surface at the rear of the ski tip is bent upward out of the bearing portion of the running surface 12 so as to provide the ski with the necessary side guidance.

The front part of the ski shown schematically in FIGS. 5 to 8 is similar to that of FIGS. 1 to 4. It is contemplated here to provide a crunched zone 14 which is produced by suitable selection of material for the ski and by development of a hollow space 15 within the tip of the ski. In this case, as in the embodiment of FIGS. 1 to 4, the surfaces of the shaped body 2 must be developed so as to be very slippery so that surface friction is as low as possible at high speeds.

The steel edges that extend along the running surfaces of the ski curve to extend inwardly along the two sides of the triangular shaped surface 11 that is developed by and between the side surfaces 7, 8. The steel edges meet in the ridge 10, which also consists in whole or in part of metal. The base of the triangular surface 11 may also consist of metal.

Figure 9:
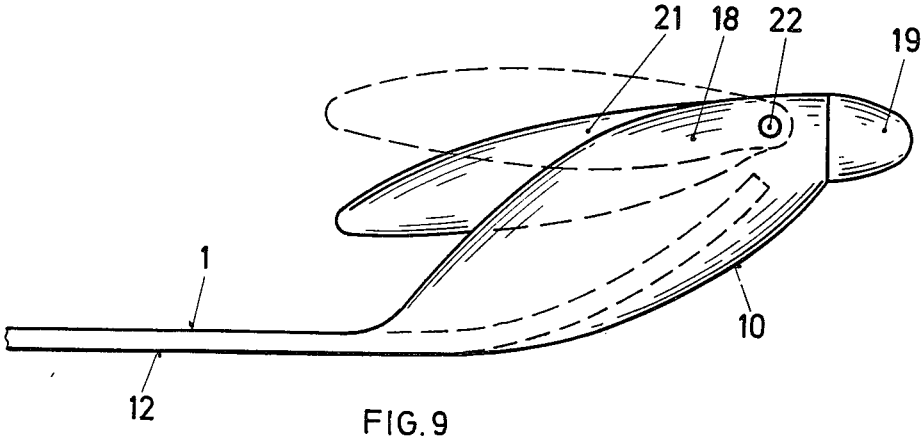
FIG. 9 is a side view of a further embodiment of a fairing of a ski tip.
Figure 10:
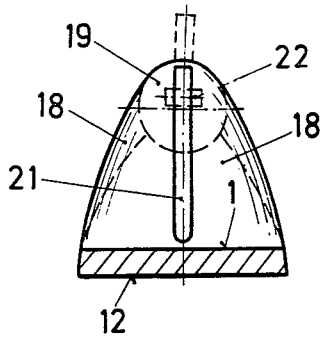
FIG. 10 is a view similar to FIG. 6 of the ski tip of FIG. 9.
Figure 11:
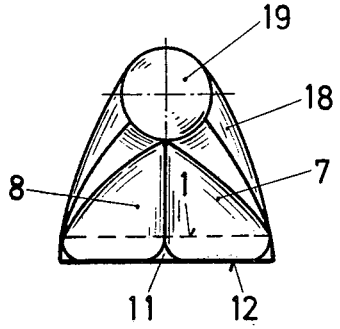
FIG. 11 is a view of the ski tip of FIG. 9, viewed from the front.
Figure 12:
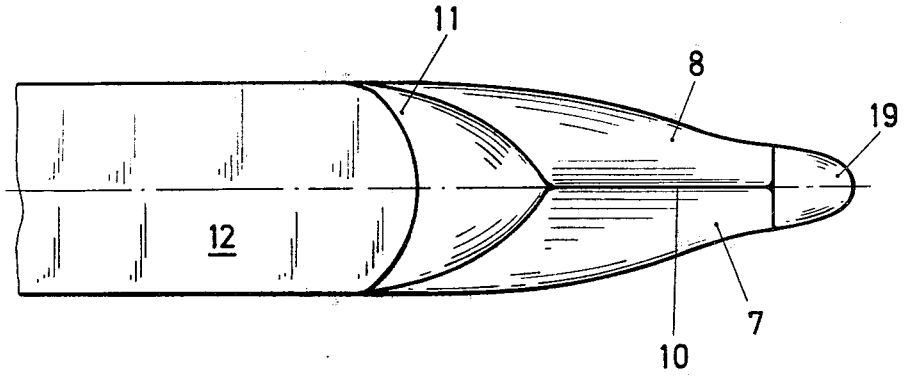
FIG. 12 is a view of the ski tip of FIG. 9, as viewed from below.

Another embodiment is shown in FIGS. 9 to 12, where a shaped body 18 that covers the ski tip is developed to have a forwardly projecting nose 19 in its front part. This nose has a small diameter cross-section and narrows to its own tip and has a shape like a radar nose cone on an airplane. In addition, a vertically oriented stabilization fin 21 is provided in the plane of longitudinal symmetry of the shaped body 18. The fin can be swung around a horizontal pivot pin 22, as indicated in FIG. 9. In this way, the guide properties of such a fairing are similar to those measured in the wind tunnel in accordance with FIG. 13.

Comparing the two curves in FIG. 13, the upper curve for a normal ski and the lower curve for a ski faired in accordance with FIGS. 1 to 4, there are obtained, at speeds of 30 m/sec, drag ratios of 13:64, which means a reduction in drag, as compared with a normal ski, by about 80%.

The evaluation of the tests in the wind tunnel showed that the drag coefficient of a normal ski was measured with $c_w$ at about 1.02 and that of a faired ski with $c_w$ at about 0.23. These values were constant within a speed range of from 10 to 40 m/sec. The front surface areas for both skis were 0.012 $m^2$. The drag coefficients $c_w$ should be $0.20 \leqq c_w \leqq 0.4$, in order to have the intended effect, or amount at most to one-third of the value without fairing.

By special dimensioning of the supports for the skis in the wind tunnel, it was possible to eliminate the drag of the supports as a factor in making the comparison.

Drag measurements as a function of the angle of attack of the ski showed that with deflections of about $\pm 3°$ from the geometrical zero direction of attack, increases in drag of less than 10% occurred. The drag curve passed through a flat minimum at the zero attack direction.

Although the ski fairing according to the invention brings about a considerable reduction in drag, its influence is, of course, to be judged in combination with the air drag on the skier and as a part of the sum of all resistances to travel which occur.

The shape of the fairing must naturally also be selected in the light of protection against accidents, for which the construction described proves excellent. Although it is possible to use metal for the fairing, it is nevertheless particularly advantageous to use elastic plastic materials such as foam rubber, rubber, polyester and the like, either in hollow form or as filled bodies. It is also possible to combine different materials. In the case of new skis, the fairing can be produced simultaneously with the manufacture of the ski, and possibly as part of it. However, it is also possible to place the fairing on existing skis, either by providing a special lock for removal, or by screwing it on. In the embodiment shown in FIGS. 5 to 8 it is also possible to equip the intended hollow space to permit the introduction of a burglar alarm device with bell or horn or radio. Such a radio system can also be advantageous in the case of avalaches or other accidents. However, it is also possible to fill such a hollow space with foam or with liquid or with some other medium.

Although the present invention has been described in connection with preferred embodiments thereof, many variations and modifications will now become apparent to those skilled in the art. It is preferred, therefore, that the present invention be limited not by the specific disclosure herein, but only by the appended claims.

What is claimed is:

1. In a ski having an upper surface and an opposed running surface;

a ski tip comprising:

an upward and forwardly directed bend at the forward end of said running surface;

said running surface at the bent tip having a generally triangular section which narrows toward the front;

two outwardly facing side covering surfaces, both extending in a direction upwardly from said running surface portion of the ski and also extending forwardly of said triangular surface; said side covering surfaces meeting at a ridge that extends generally along the longitudinal central plane of said ski tip and said ridge extending forwardly and being generally inclined upwardly further from said triangular surface;

said ridge having a downward curvature with respect to the main axis of the ski tip at the front extremity of said tip;

an upper surface connected to both said side surfaces and extending over the top of said ski tip and merging into the upper surface of the ski, for defining a closed ski tip which includes said side covering surfaces and said upper surface.

2. The ski tip of claim 1, wherein said upper surface is generally rounded over the top thereof in a transverse cross-section through said ski tip and said upper surface meets said side covering surfaces along downwardly sloping sides of said upper surface.

3. The ski tip of claim 2, wherein said upper surface of said ski tip has a generally S-shaped longitudinal cross-section turning downwardly at the front end thereof.

4. The ski tip of claim 3, wherein said side surfaces are concavely profiled.

5. The ski of claim 1, wherein the tip section comprises a fairing mountable at the front of a ski, said fairing having the said triangular construction, sides, ridge and upper surface.

6. The ski of claim 1 wherein at speeds of 10 to 40 meters per second, the air drag ratio of said ski is reduced to the order of 25% of the drag ratio of a ski having a standard tip.

7. A ski, comprising:

a main body of the ski, having an upper surface and having an opposite running surface; the ski having a front;

said ski front having a streamlining tip at said ski upper surface; said tip comprising:

said ski running surface having a portion that is bent upwardly and forwardly of the remainder of said running surface, said portion being located at said tip and forming there a generally triangular surface, which narrows in the direction toward said front of said ski;

two outwardly facing side covering surfaces, extending in a direction upwardly from said running surface portion and extending forwardly of said triangular surface; said side covering surfaces meeting at a ridge that extends generally along the longitudinal central plane of the ski, and said ridge extending forwardly and being generally inclined upwardly further from said triangular surface; and having a downward inclination from the main axis of the tip at the front extremity of the ski;

an upper surface meeting both said side covering surfaces and extending over the top of said ski tip, and merging into said ski upper surface, for defining a closed said ski tip, including said side covering surfaces and said upper surface.

8. The ski of claim 7, wherein said triangular surface has side edges leading forwardly from said running surface and leading forwardly to said ridge; said side edges of said triangular surface being comprised of metal.

9. The ski of claim 8, wherein at least part of said ridge is comprised of metal.

10. The ski of claim 7, wherein said upper surface is generally rounded over the top thereof in a transverse cross-section through said ski tip and said upper surface meets said side covering surfaces along downwardly sloping sides of said upper surface.

11. The ski of claim 10, wherein said upper surface of said ski tip has a generally S-shaped longitudinal cross-section, turning downwardly at the front end thereof.

12. The ski of claim 11, wherein said ski tip generally has the shape of a thrush head or a dolphin head.

13. The ski of any of claims 7, 10 or 11, wherein said side surfaces are concavely profiled.

14. The ski of claim 13, wherein said side covering surface meets said upper surface at respective rounding for each said side covering surface.

15. The ski of any of claims 7, 10 or 11, wherein at the forward end of said tip, said tip has a forwardly projecting, narrow diameter, narrowed tip nose.

16. The ski of claim 7, wherein said ski tip is a hollow defined by said upper surface, said side surfaces and said triangular surface.

* * * * *